US007359653B2

(12) United States Patent
Okamoto

(10) Patent No.: US 7,359,653 B2
(45) Date of Patent: Apr. 15, 2008

(54) FIXING DEVICE, IMAGE FORMING APPARATUS INCLUDING THE FIXING DEVICE, AND FIXING METHOD

(75) Inventor: Masami Okamoto, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 57 days.

(21) Appl. No.: 10/820,851

(22) Filed: Apr. 9, 2004

(65) Prior Publication Data

US 2004/0202490 A1 Oct. 14, 2004

(30) Foreign Application Priority Data

Apr. 10, 2003 (JP) ..... 2003-106795
Apr. 2, 2004 (JP) ..... 2004-110099

(51) Int. Cl.
*G03G 15/20* (2006.01)

(52) U.S. Cl. ..... 399/69; 399/70

(58) Field of Classification Search ..... 219/216; 399/69, 70, 82, 108, 67, 88, 89, 90
See application file for complete search history.

(56) References Cited

U.S. PATENT DOCUMENTS 6,239,864 B1 5/2001 Okamoto
6,394,446 B1 5/2002 Okamoto
6,411,795 B2 6/2002 Okamoto
6,542,705 B2 * 4/2003 Fujita et al. ..... 399/69

FOREIGN PATENT DOCUMENTS

JP 03-005779 * 1/1991
JP 3-36579 2/1991
JP 2000-98799 4/2000

* cited by examiner

*Primary Examiner*—Hoang Ngo
(74) *Attorney, Agent, or Firm*—Oblon, Spivak, McClelland, Maier & Neustadt, P.C.

(57) ABSTRACT

A fixing device for fixing an image formed on a recording medium includes a fixing member, a pressing member, a heat source that heats the fixing member, a storage device that supplies power to the heat source, a pressing member temperature estimating device, and a control device that changes the amount of power supplied from the storage device to the heat source based on the temperature of the pressing member. The temperature estimating device estimates the temperature based on at least one of an elapsed time since a start of image formation, a number of recording media on which images are formed since the start of image formation, a local ambient temperature in the vicinity of the fixing member, and a change of temperature of the fixing member.

9 Claims, 14 Drawing Sheets

FIXING DEVICE, IMAGE FORMING APPARATUS INCLUDING THE FIXING DEVICE, AND FIXING METHOD

CROSS-REFERENCE TO RELATED APPLICATIONS

This application claims priority to Japanese Patent Application No. 2003-106795 filed in the Japanese Patent Office on Apr. 10, 2003, and Japanese Patent Application No. 2004-110099 filed in the Japanese Patent Office on Apr. 2, 2004, the disclosures of which are incorporated herein by reference in their entirety.

BACKGROUND OF THE INVENTION

1. Field of the Invention

The present invention relates to a fixing device and a fixing method in which an image is fixed onto a recording medium while supplying power to a heat source from a storage device, and to an image forming apparatus including the fixing device.

2. Discussion of the Related Art

An electrophotographic image forming apparatus, such as a copying machine, a printer, a facsimile machine, or other similar image forming apparatus, includes a fixing device that fixes a toner image formed on a recording media, such as a transfer sheet, with heat and pressure. The fixing device generally includes a fixing member, such as, a fixing roller and a fixing belt, and a pressing member, such as, a pressing roller, a pressing belt, and a pressing pad, which press-contacts the fixing member. The fixing member and pressing member cooperate to fix a toner image on a transfer sheet with heat and pressure while the transfer sheet passes through a nip part between the fixing member and pressing member.

Published Japanese patent application No. 3-36579 describes a heating device for use in a fixing device including a heater that heats by being supplied with power via a heater drive device. The heater drive device includes a chargeable storage battery, and a charger connected to a commercial power source for charging the storage battery. The heater includes a main heater powered by the commercial power source and an auxiliary heater powered by the storage battery. The storage battery is selectively connected to the charger in the form of a charging circuit or to the auxiliary heater in the form of a discharging circuit.

Further, Published Japanese patent application No. 2000-98799 describes a heating device for use in a fixing device including a heater that heats by being supplied with power, and a heater drive device for feeding power to the heater. The heater drive device includes a chargeable storage battery, and a charger connected to a commercial power source for charging the storage battery. The heater includes a main heater powered by the commercial power source and an auxiliary heater powered by the storage battery. The storage battery is charged when the main heater is turned off.

In a background fixing device, a surface temperature of a fixing member may fall to a lower limit of a fixing temperature or less even though a heater or a heat source is powered by a storage device. In this condition, a fixing failure typically occurs.

Therefore, it is desirable to provide a fixing device for use in an image forming apparatus that prevents a fixing failure.

Further, it is desirable to provide a method of fixing an image formed on a recording medium without a fixing failure.

SUMMARY OF THE INVENTION

According to an aspect of the present invention, a fixing device for fixing an image formed on a recording medium includes a fixing member arranged on a recording medium conveying path, a pressing member configured to press-contact the fixing member, a heat source configured to heat the fixing member, a storage device configured to supply power to the heat source, and a control device configured to change an amount of power supplied from the storage device to the heat source based on the time elapsed since the start of image formation.

The fixing device may further include a device configured to detect the temperature of the fixing member. The control device may be configured to compare the temperature of the fixing member with a reference temperature and to change the amount of power supplied from the storage device to the heat source based on this comparison. The control device may also be configured to change the reference temperature based on the time elapsed since the start of image formation.

According to another aspect of the present invention, a fixing device for fixing an image formed on a recording medium includes a fixing member arranged on a recording medium conveying path, a pressing member configured to press-contact the fixing member, a heat source configured to heat the fixing member, a storage device configured to supply power to the heat source, and a control device configured to change the amount of power supplied from the storage device to the heat source based on the number of recording media used since the start of image formation.

According to another aspect of the present invention, a fixing device for fixing an image formed on a recording medium includes a fixing member arranged on a recording medium conveying path, a pressing member configured to press-contact the fixing member, a heat source configured to heat the fixing member, a storage device configured to supply power to the heat source, a temperature detecting device configured to detect the local ambient temperature in the vicinity of the fixing member, and a control device configured to change the amount of power supplied from the storage device to the heat source based on the local ambient temperature detected by the temperature detecting device.

According to another aspect of the present invention, a fixing device for fixing an image formed on a recording medium includes a fixing member arranged on a recording medium conveying path, a pressing member configured to press-contact the fixing member, a heat source configured to heat the fixing member, a storage device configured to supply power to the heat source, and a control device configured to change the amount of power supplied from the storage device to the heat source based on the difference between the temperature of the fixing member and the temperature of the pressing member.

According to another aspect of the present invention, a fixing device for fixing an image formed on a recording medium includes a fixing member arranged on a recording medium conveying path, a pressing member configured to press-contact the fixing member, a heat source configured to heat the fixing member, a storage device configured to supply power to the heat source, a temperature detecting device configured to detect the temperature of the pressing member, and a control device configured to change the amount of power supplied from the storage device to the heat source based on the temperature of the pressing member detected by the temperature detecting device.

According to another aspect of the present invention, a fixing device for fixing an image formed on a recording medium includes a fixing member arranged on a recording medium conveying path, a pressing member configured to press-contact the fixing member, a heat source configured to heat the fixing member, a storage device configured to supply power to the heat source, a device configured to estimate the temperature of the pressing member, and a control device configured to change the amount of power supplied from the storage device to the heat source based on the temperature of the pressing member estimated by the temperature estimating device.

The temperature estimating device may be configured to estimate the temperature of the pressing member based on at least one of the time that elapses since the start of image formation, the number of recording media used since the start of image formation, the local ambient temperature in the vicinity of the fixing member, and the change in temperature of the fixing member.

According to yet another aspect of the present invention, an image forming apparatus includes an image forming device configured to form an image on a recording medium, and one of the above-described fixing devices.

According to yet another aspect of the present invention, a method of fixing an image formed on a recording medium includes, supplying power to a heat source from a storage device; heating a fixing member by the heat source; passing the recording medium having the image through a nip part between the fixing member and a pressing member; and changing the amount of power supplied from the storage device to the heat source based on the time elapsed since the start of image formation.

According to yet another aspect of the present invention, a method of fixing an image formed on a recording medium includes, supplying power to a heat source from a storage device; heating a fixing member by the heat source; passing the recording medium having the image through a nip part between the fixing member and a pressing member; and changing the amount of power supplied from the storage device to the heat source based on the number of recording media used since the start of image formation.

According to yet another aspect of the present invention, a method of fixing an image formed on a recording medium includes, supplying power to a heat source from a storage device; heating a fixing member by the heat source; passing the recording medium having the image through a nip part between the fixing member and a pressing member; detecting the local ambient temperature in the vicinity of the fixing member; and changing the amount of power supplied from the storage device to the heat source based on the detected local ambient temperature.

According to yet another aspect of the present invention, a method of fixing an image formed on a recording medium includes, supplying power to a heat source from a storage device; heating a fixing member by the heat source; passing the recording medium having the image through a nip part between the fixing member and a pressing member; and changing the amount of power supplied from the storage device to the heat source based on the difference between the temperature of the fixing member and the temperature of the pressing member.

According to yet another aspect of the present invention, a method of fixing an image formed on a recording medium includes, supplying power to a heat source from a storage device; heating a fixing member by the heat source; passing the recording medium having the image through a nip part between the fixing member and a pressing member; detecting the temperature of the pressing member; and changing the amount of power supplied from the storage device to the heat source based on the detected temperature of the pressing member.

According to yet another aspect of the present invention, a method of fixing an image formed on a recording medium includes, supplying power to a heat source from a storage device; heating a fixing member by the heat source; passing the recording medium having the image through a nip part between the fixing member and a pressing member; estimating the temperature of the pressing member; and changing the amount of power supplied from the storage device to the heat source based on the estimated temperature of the pressing member.

According to yet another aspect of the present invention, a method of fixing an image formed on a recording medium includes, supplying power to a heat source from a storage device; heating a fixing member by the heat source; passing the recording medium having the image through a nip part between the fixing member and a pressing member; estimating the amount of heat transferred from the fixing member to the pressing member; and changing the amount of power supplied from the storage device to the heat source based on the estimated amount of heat transferred from the fixing member to the pressing member.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
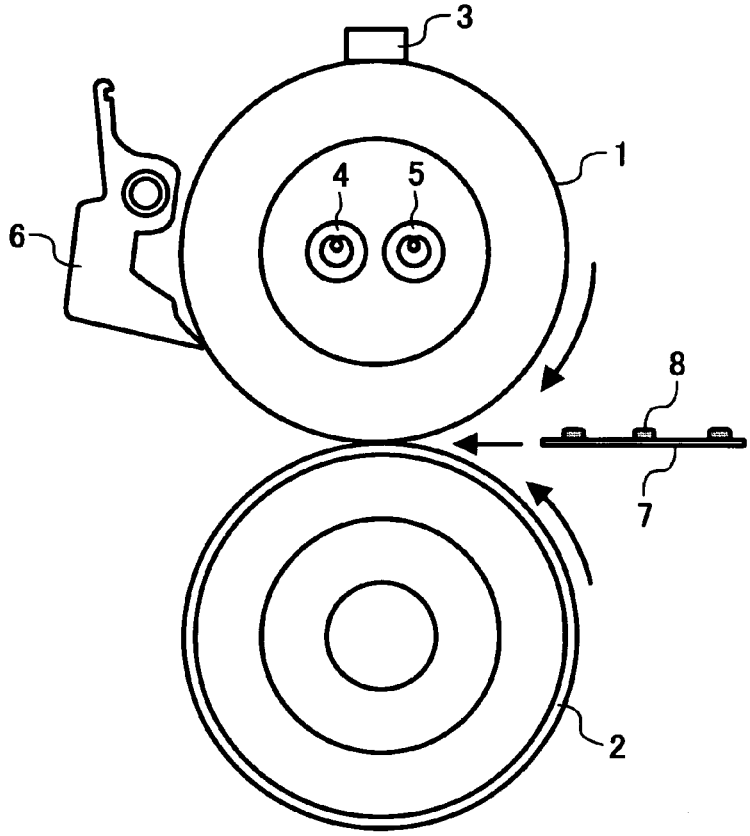
FIG. 1 is a schematic view of a fixing device according to an embodiment of the present invention.

Preferred embodiments of the present invention are described in detail referring to the drawings, wherein like reference numerals designate identical or corresponding parts throughout the several views.

To achieve energy saving in an image forming apparatus, the consumption energy in a stand-by state after image formation needs to be reduced. Therefore, the surface temperature of a fixing roller serving as a heat roller in a stand-by state needs to be reduced. Further, to decrease the warm-up time necessary for raising the surface temperature of the fixing roller to a desired fixing temperature, the thermal capacity of the fixing roller needs to be reduced. If a transfer sheet absorbs heat from the fixing roller at the time of image formation, i.e., while a transfer sheet passes through a nip part between the fixing roller and a pressing roller, as compared with a fixing roller having a large thermal capacity, the surface temperature of the fixing roller having a small thermal capacity rapidly decreases, thereby reaching a lower fixing temperature limit. In this case, a fixing failure typically occurs.

To address the above-described problem, a background image forming apparatus includes a chargeable auxiliary power source. In the background image forming apparatus, the drop in surface temperature of a fixing roller is prevented by supplying power to a heater from the auxiliary power source at the time of image formation. Because the capacity of the auxiliary power source is limited, it is generally controlled such that power is supplied to the heater only when the surface temperature of the fixing roller reaches a lower fixing temperature limit.

As another condition, the temperature of a pressing roller, which press-contacts a fixing roller, is relatively low immediately after a start of image formation, so the pressing roller absorbs heat from the fixing roller at an early stage. In this condition, even if power is supplied to a heater from an auxiliary power source when the surface temperature of the fixing roller reaches a lower fixing temperature limit, the surface temperature of the fixing roller cannot be rapidly raised to the fixing temperature. As a result, a fixing failure typically occurs due to a low surface temperature of the fixing roller. Specifically, when the temperature of the pressing roller is low, the amount of heat transferred from the fixing roller to the pressing roller is great. In this condition, even if the auxiliary power source is turned on when the surface temperature of the fixing roller reaches a lower limit of the fixing temperature, the surface temperature of the fixing roller cannot be maintained at an acceptable fixing temperature. As a result, a fixing failure typically occurs. Such a fixing failure is obviated by implementing the exemplary embodiments of the present invention described below.

FIG. 1 is a schematic view of a fixing device (so-called heat fixing device) according to an embodiment of the present invention. A fixing device includes a fixing roller 1 and a pressing roller 2 formed from an elastic member such as a silicon rubber. The pressing roller 2 is press-contacted against the fixing roller 1 with a predetermined pressing force by a pressing device (not shown). The fixing device is configured such that a recording medium, such as, a transfer sheet 7, passes through a nip part between the fixing roller 1 and the pressing roller 2. As illustrated in FIG. 1, the fixing device uses the fixing roller 1 as the fixing member and the pressing roller 2 as the pressing member. Alternatively, the fixing device may use an endless belt for at least one of the fixing member and the pressing member.

The fixing device includes electric heat sources in the form of a first heater 4 and a second heater 5. Specifically, the first heater 4 and second heater 5 may be disposed at any desired position where the first heater 4 and second heater 5 heat the fixing roller 1. In this embodiment, the first heater 4 and second heater 5 are disposed in the fixing roller 1 to heat the fixing roller 1 from inside. The fixing device of FIG. 1 has construction in which the fixing roller 1 functions as a heat roller heated by a radiation heater from inside and also functions as a sheet conveying roller. For example, the second heater 5 may be in a shape of a sheet and may cover an upper part of the fixing roller 1 to heat the fixing roller 1 from outside.

The fixing roller 1 and the pressing roller 2 are driven to rotate by a drive mechanism (not shown). A temperature sensor 3 contacts the surface of the fixing roller 1 to detect its surface temperature. As illustrated in FIG. 1, the transfer sheet 7 carries a toner image 8 on the fixing roller side. While the transfer sheet 7 passes through a nip part between the fixing roller 1 and the pressing roller 2, the toner image 8 is fixed onto the transfer sheet 7 under the influence of heat and pressure. The leading edge of a separation pick 6 is in sliding-contact with the surface of the fixing roller 1 at a downstream side of the nip part between the fixing roller 1 and the pressing roller 2 in a sheet conveying direction to remove the transfer sheet 7 from the surface of the fixing roller 1.

Figure 2:
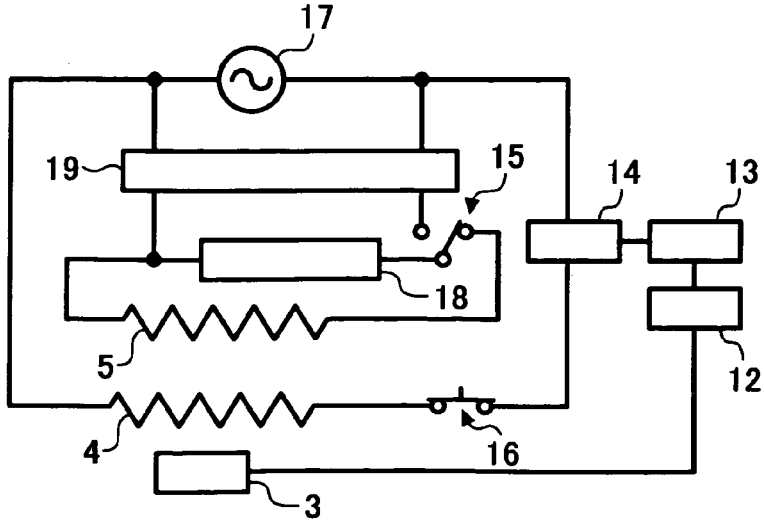
FIG. 2 is a block diagram of a control circuit of the fixing device according to an embodiment of the present invention.

FIG. 2 is a block diagram of a control circuit of the fixing device according to the embodiment of the present invention. The control circuit functions as a control device that changes the amount of power supplied to each the first heater 4 and the second heater 5. The first heater 4 is powered by a commercial power source 17, and the second heater 5 is powered by energy stored in the capacitor 18. The capacitor 18 is connected to a charger 19, and the charger 19 is connected to the commercial power source 17. At one side of the capacitor 18, a switch 15 switches the connection condition between the charger 19 and the second heater 5. Normally, the capacitor 18 and the charger 19 are connected.

When supplying power to the second heater 5, the circuit on the charger side is opened, and the circuit on the second heater side is closed.

The first heater 4 is connected to the commercial power source 17 via a safety thermostat 16 and a driver 14. The driver 14 is controlled by a central processing unit (CPU) 13 to control power supply from the commercial power source 17 to the first heater 4. The thermostat 16 detects the temperature in the fixing device and shuts off power supply from the commercial power source 17 to the first heater 4 when the temperature in the fixing device rises above a predetermined upper limit. Instead of the thermostat 16, a temperature fuse may be used as a safety device.

A detection signal output from the temperature sensor 3 is transmitted to the CPU 13 via an input circuit 12. The CPU 13 controls power supply to the first heater 4 via the driver 14 and controls power supply to the second heater 5 via the switch 15 such that the surface temperature of the fixing roller 1 is maintained at a predetermined value, in accordance with a signal output from the temperature sensor 3.

The CPU 13 switches the switch 15 depending on whether the fixing device is in a stand-by state or an operation state, thereby switching the connection of the capacitor 18 to the charger 19 or the second heater 5. In the stand-by state, the switch 15 switches the connection of the capacitor 18 to the charger 19. The charger 19 charges the capacitor 18 by applying a direct current (DC) power, which has been converted from an alternating current (AC) power by the charger 19.

In the operation state of the fixing device, the switch 15 switches the connection of the capacitor 18 to the second heater 5 at the time of warming-up the fixing device, so that the second heater 5 is driven by DC power from the capacitor 18. Specifically, at the time of warming-up the fixing device, the first heater 4 is driven by AC power from the commercial power source 17 via the driver 14, and the second heater 5 is driven by DC power from the capacitor 18. Thereby, the surface temperature of the fixing roller 1 rapidly rises to a predetermined temperature. After the fixing device is warmed-up, the CPU 13 controls power supply to the first heater 4 via the driver 14 such that the surface temperature of the fixing roller 1 is maintained at a predetermined temperature.

For example, an electric double-layer capacitor having a large capacitance of greater than several hundred farad (F) is used as the capacitor 18. Alternatively, the capacitor 18 may be made by connecting a plurality of electrolytic capacitors. In this embodiment, power is supplied from both the commercial power source 17 and the capacitor 18. However, if a storage device having a large capacity is used, it may be configured such that the first heater 4 is also powered by a capacitor (storage device) instead of the commercial power source 17.

In the fixing device of the present embodiment, by using power supplied from both a main power source (the commercial power source 17) and an auxiliary power source (the capacitor 18), an amount of heating energy greater than the maximum produced by the main power source can be provided to the fixing roller 1 during a predetermined time, i.e., the discharging time of the capacitor 18.

Figure 3:
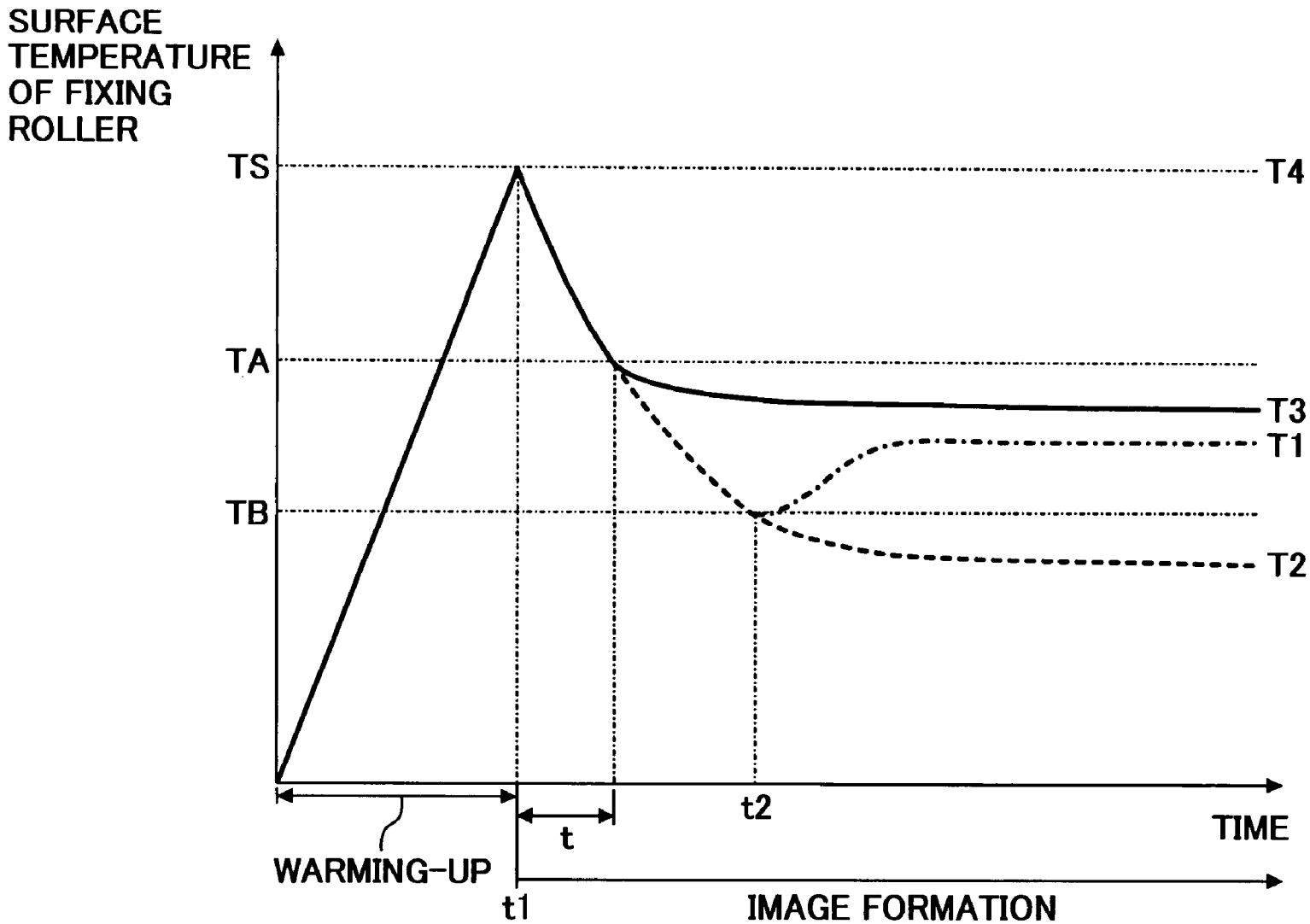
FIG. 3 is a graph showing the variation of the surface temperature of a fixing roller with time according to an embodiment of the present invention.
Figure 4:
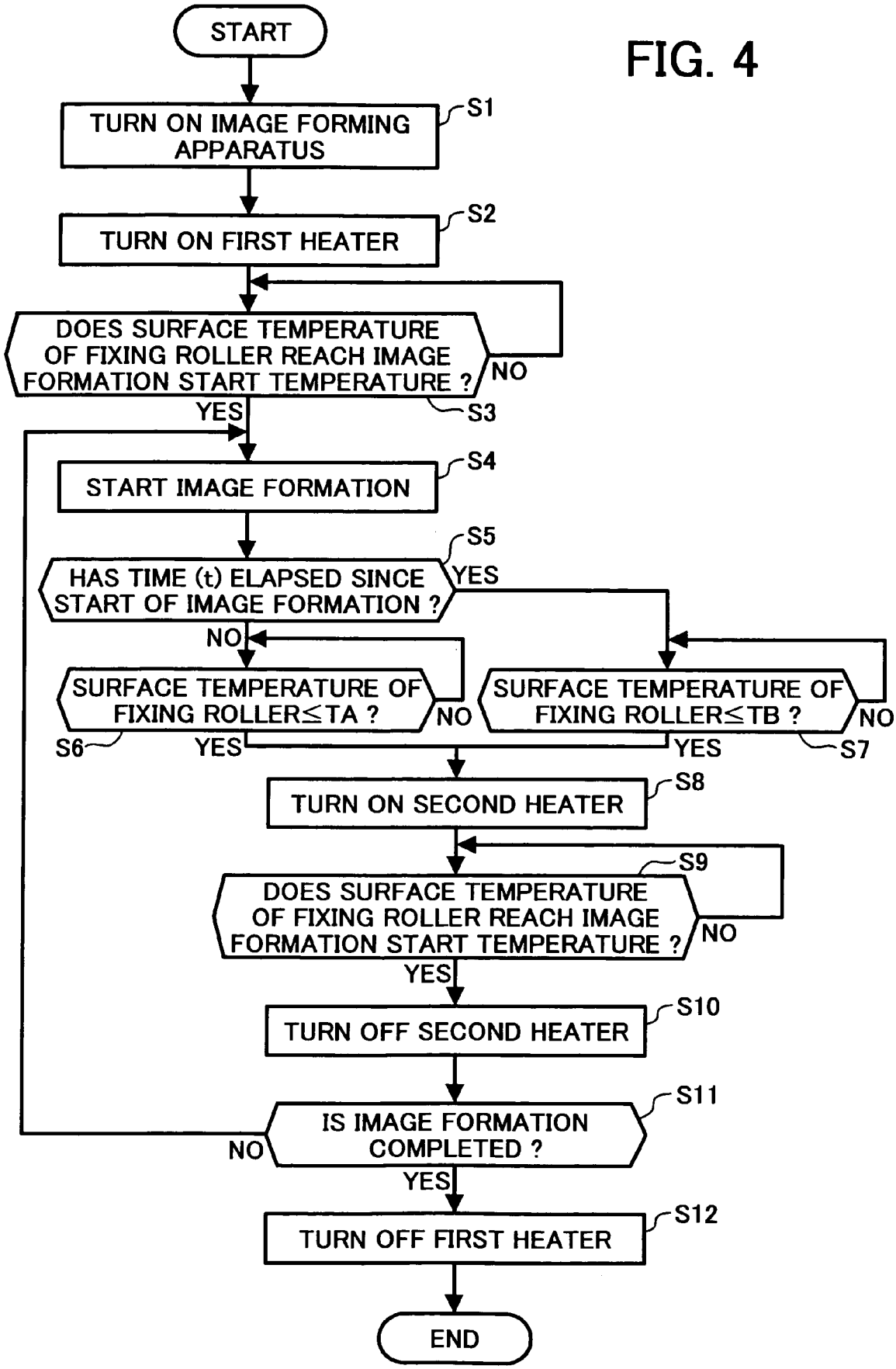
FIG. 4 is a flowchart of heating control operation steps of a CPU according to an embodiment of the present invention.

FIG. 3 is a graph showing a relationship between the surface temperature of the fixing roller 1 and time according to an embodiment of the present invention. FIG. 4 is a flowchart of heating control operation steps of the CPU 13 according to the embodiment of the present invention.

Referring to FIG. 4, after an image forming apparatus is turned on in step S1, the first heater 4 is turned on such that the surface temperature of the fixing roller 1 rises to an image formation start temperature (TS) in step S2. Alternatively, the second heater 5 may be turned on in addition to the first heater 4 until the surface temperature of the fixing roller 1 rises to the image formation start temperature (TS) in step S2. The rise of the surface temperature of the fixing roller 1 to the image formation start temperature (TS) is shown in the graph of FIG. 3. Then, the CPU 13 determines if the surface temperature of the fixing roller 1 reaches the image formation start temperature (TS) in step S3. If the answer is NO in step S3, the heating control operation returns to reexecute step S3. If the answer is YES in step S3, the CPU 13 starts an image forming operation of the image forming apparatus in step S4. In FIG. 3, the image formation starting time is denoted by t1. Strictly speaking, the term of the image formation starting time refers to a rotation starting time of the fixing roller 1 and pressing roller 2 in this embodiment.

Immediately after the start of image formation, only the first heater 4 is powered. When the transfer sheet 7 enters the nip part between the fixing roller 1 and the pressing roller 2 in this condition, the transfer sheet 7 and toner image 8 absorb heat from the fixing roller 1, thereby lowering the surface temperature of the fixing roller 1. In this embodiment, a first reference temperature (TB) and a second reference temperature (TA) are set. As shown in FIG. 3, the second reference temperature is greater than the first reference temperature. The range between the first reference temperature and the second reference temperature corresponds to a range of adequate fixing temperature. Therefore, the first reference temperature corresponds to a lower limit of the fixing temperature, and the second reference temperature corresponds to an upper limit of the fixing temperature. If the surface temperature of the fixing roller 1 falls below the first reference temperature or exceeds the second reference temperature, a fixing failure typically occurs, thereby causing a poor image quality.

After the start of image formation in step S4, the CPU 13 determines if a time (t) has elapsed since the start of image formation in step S5. If the answer is NO in step S5, the CPU 13 determines if the surface temperature of the fixing roller 1 detected by the temperature sensor 3 is equal to or less than the second reference temperature in step S6. If the answer is NO in step S6, the heating control operation returns to reexecute step S6. If the answer is YES in step S6, the CPU 13 turns on the second heater 5 to heat the fixing roller 1 in step S8. In this condition, sufficient power is fed to both the first heater 4 and second heater 5, thereby adequately raising the surface temperature of the fixing roller 1 as indicated by a solid line (T3) in FIG. 3.

If the time t has elapsed since the start of image formation in step S5 (i.e., the answer is YES in step S5), the CPU 13 determines if the surface temperature of the fixing roller 1 detected by the temperature sensor 3 is equal to or less than the first reference temperature in step S7. If the answer is NO in step S7, the heating control operation returns to reexecute step S7. If the answer is YES in step S7, the CPU 13 turns on the second heater 5 to heat the fixing roller 1 in step S8.

The second heater 5 is turned on (i.e., the second heater 5 is powered by the capacitor 18) until the surface temperature of the fixing roller 1 reaches the image formation start temperature or the capacitor 18 completely discharges. Therefore, the CPU 13 determines if the surface temperature of the fixing roller 1 reaches the image formation start temperature in step S9. If the answer is NO in step S9, the heating control operation returns to reexecute step S9. If the answer is YES in step S9, the CPU 13 turns off the second heater 5 in step S10. Then, the CPU 13 determines if the image forming operation of the image forming apparatus is completed in step S11. If the answer is YES in step S11, the CPU 13 turns off the first heater 4 in step S12. If the answer is NO in step S11, the heating control operation returns to reexecute step S4.

In the above-described heating control operation, the CPU 13 also controls the heating temperature of the first heater 4 (i.e., the amount of power supplied to the first heater 4) based on the output from the temperature sensor 3. When the time t has not elapsed since the start of the image formation in step S5 (i.e., the answer is NO in step S5), the temperature of the pressing roller 2 is low. Therefore, the pressing roller 2 may absorb the heat from the fixing roller 1. For this reason, the second heater 5 is turned on when the surface temperature of the fixing roller 1 detected by the temperature sensor 3 is equal to or less than the second reference temperature. On the other hand, when the time t has elapsed since the start of the image formation in step S5 (i.e., the answer is YES in step S5), the temperature of the pressing roller 2 rises sufficiently to prevent or minimize heat absorption from the fixing roller 1. In this condition, the heat from the fixing roller 1 may be absorbed by the transfer sheet 7, the toner image 8, etc.

In a normal heating control operation, the second heater 5 is turned on (i.e., the second heater 5 is powered by the capacitor 18) at a time (t2) shown in FIG. 3, when the surface temperature of the fixing roller 1 falls below the first reference temperature. As a result, the surface temperature of the fixing roller 1 rises as indicated by the dashed lines T1 in FIG. 3. Under the normal condition in which the air temperature and the temperature of the pressing roller 2 are not low, the surface temperature of the fixing roller 1 remains as indicated by the dashed line T1 in FIG. 3. However, even if the second heater 5 is turned on (i.e., the second heater 5 is powered by the capacitor 18) when the surface temperature of the fixing roller 1 falls below the first reference temperature, the surface temperature of the fixing roller 1 may not rise and exceed the first reference temperature as indicated by dotted line T2 in FIG. 3. The reason why the surface temperature of the fixing roller 1 does not rise even though the second heater 5 is turned on when the surface temperature of the fixing roller 1 falls below the first reference temperature is that the air temperature and/or the temperature of the pressing roller 2 are relatively low. Thus, in the embodiment of the present invention, when the air temperature and/or the temperature of the pressing roller 2 are relatively low, the second heater 5 is turned on while discharging the capacitor 18 when the surface temperature of the fixing roller 1 detected by the temperature sensor 3 is equal to or less than the second reference temperature. Thereby, the surface temperature of the fixing roller 1 rises as indicated by the solid line T3 in FIG. 3. With the above-described heating control operation, the surface temperature of the fixing roller 1 can be maintained in the range (i.e., the range of adequate fixing temperature) between the first reference temperature and the second reference temperature similarly as in the case of the surface temperature of the fixing roller 1 indicated by the dashed line T1 in FIG. 3.

The first reference temperature and the second reference temperature are set by carrying out experiments, and may be changed based on a plurality of parameters, such as, the thermal capacity of the fixing roller 1, the thermal capacity of the pressing roller 2, the thermal capacity of the transfer sheet 7, which varies depending on size and thickness of the sheet, and the thermal capacity of toner.

Figure 5:
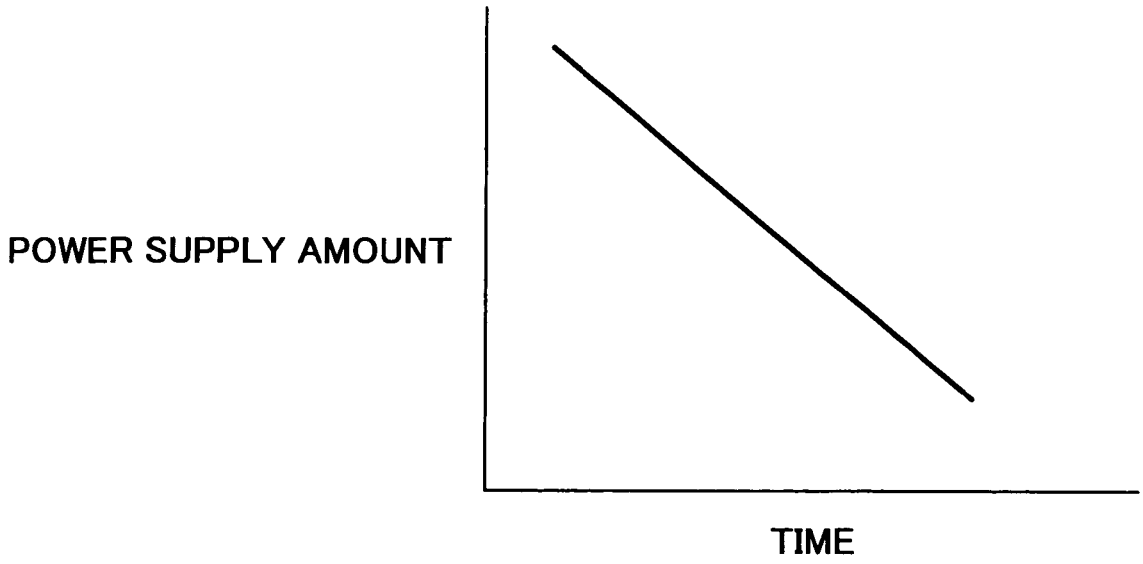
FIG. 5 is a graph showing the variation of the amount of power supply from a capacitor with time elapsed since the start of image formation.

FIG. 5 is a graph showing a relationship between the amount of power supplied from the capacitor 18 and time elapsed since the start of image formation. As shown in FIG. 5, the amount of power supplied from the capacitor 18 and the time elapsed since the start of image formation are in inverse proportion. Therefore, if this relation is stored in a table, the CPU 13 can retrieve the amount of power to be supplied from the capacitor 18 to the second heater 5 based on the time elapsed since the start of image formation. Thus, the CPU 13 can control the amount of power supplied from the capacitor 18 to the second heater 5 based on the retrieved information just described.

The amount of heat transferred from the fixing roller 1 to the pressing roller 2 is obtained by integrating as a function time the difference between the dashed line T4, indicating an image formation start temperature and extending in parallel to the horizontal axis, and the descending characteristic curve of the surface temperature of the fixing roller 1 in the graph of FIG. 3.

Figure 6:
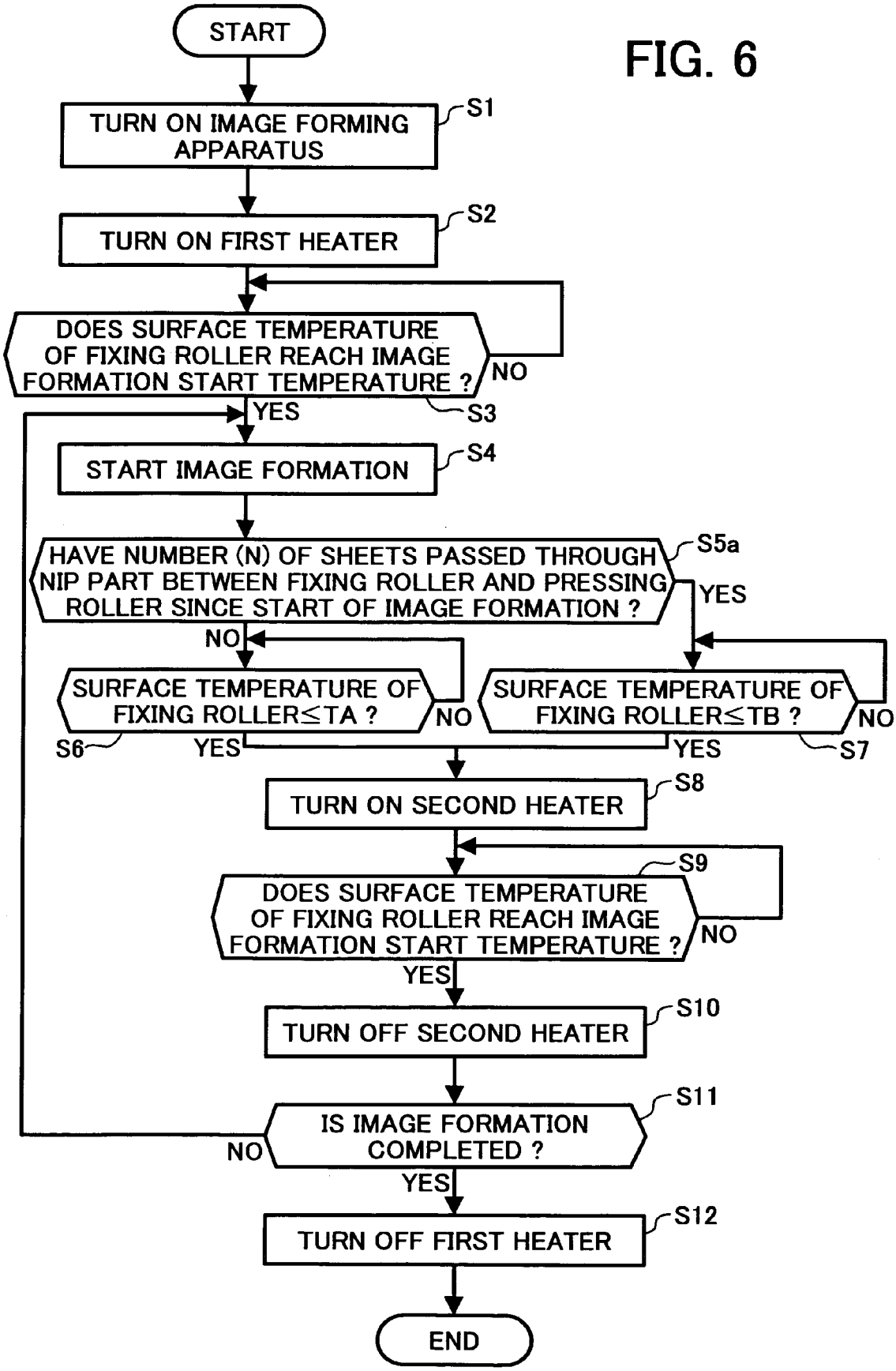
FIG. 6 is a flowchart of heating control operation steps of the CPU according to another embodiment of the present invention.
Figure 7:
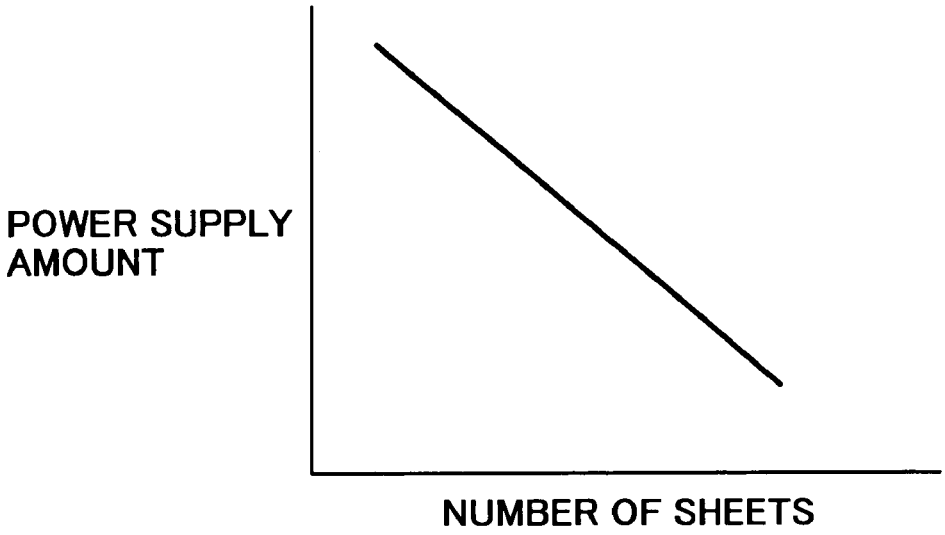
FIG. 7 is a graph showing the variation of the amount of power supply from a capacitor as a function of the number of sheets.

FIG. 6 is a flowchart of heating control operation steps of the CPU 13 according to another embodiment of the present invention. FIG. 7 is a graph showing a relationship between the amount of power supplied from the capacitor 18 and the number of sheets. In this embodiment, the heating control operation of the CPU 13 is performed based on the number of sheets used since the start of image formation.

In this embodiment, as shown in FIG. 6, after an image forming apparatus is turned on in step S1, the heating control operation steps S2 through S4 in FIG. 6 are performed similarly as in steps S2 through S4 in FIG. 4. In step S5*a*, the CPU 13 determines the number (N) of sheets have passed through the nip part between the fixing roller 1 and the pressing roller 2 since a start of image formation. If the answer is NO in step S5*a*, the CPU 13 determines if the surface temperature of the fixing roller 1 detected by the temperature sensor 3 is equal to or less than the second reference temperature in step S6. If the answer is YES in step S5*a*, the CPU 13 determines if the surface temperature of the fixing roller 1 detected by the temperature sensor 3 is equal to or less than the first reference temperature in step S7. The heating control operation steps S8 through S12 are performed similarly as in steps S8 through S12 in FIG. 4. With the above-described heating control operation, the surface temperature of the fixing roller 1 is maintained at an adequate fixing temperature in the range between the first reference temperature and the second reference temperature.

In this embodiment, the number of sheets in step S5*a* is preset based on an experimental result of a relationship between sheet size and the number of sheets, and a relationship between a temperature decrease and the number of sheets. Further, the number of sheets in step S5*a* is changed according to a sheet size considering the thermal capacity of the sheet.

As shown in FIG. 7, the amount of power supplied from the capacitor 18 and the number of sheets that have passed through the nip part between the fixing roller 1 and the pressing roller 2 are in inverse proportion. If this relation is stored in a table, the CPU 13 can retrieve the amount of power to be supplied from the capacitor 18 to the second heater 5 based on the number of sheets that have passed through the nip part between the fixing roller 1 and the pressing roller 2. Thus, the CPU 13 can control the amount of power supplied from the capacitor 18 to the second heater 5 based on the retrieved information just described.

Figure 8:
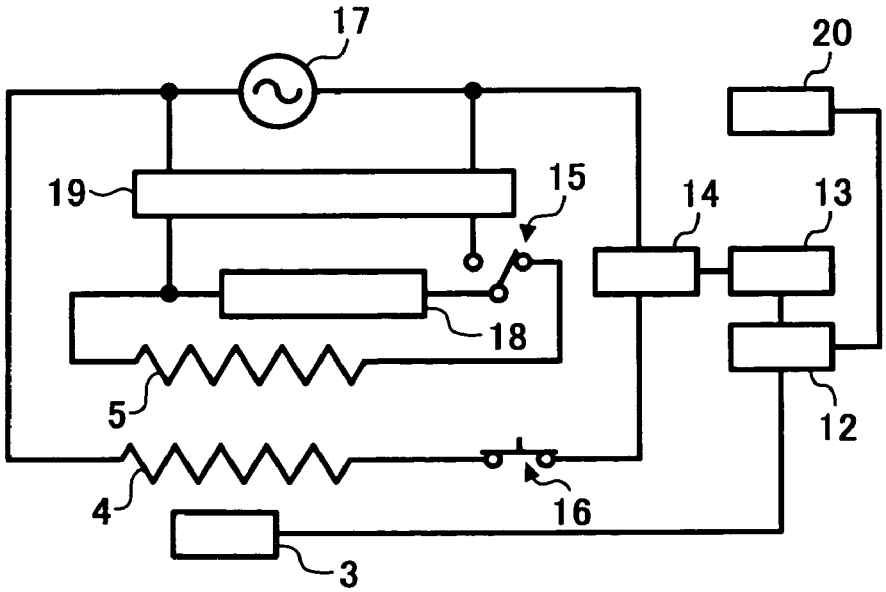
FIG. 8 is a block diagram of a control circuit of a fixing device according to another embodiment of the present invention.
Figure 9:
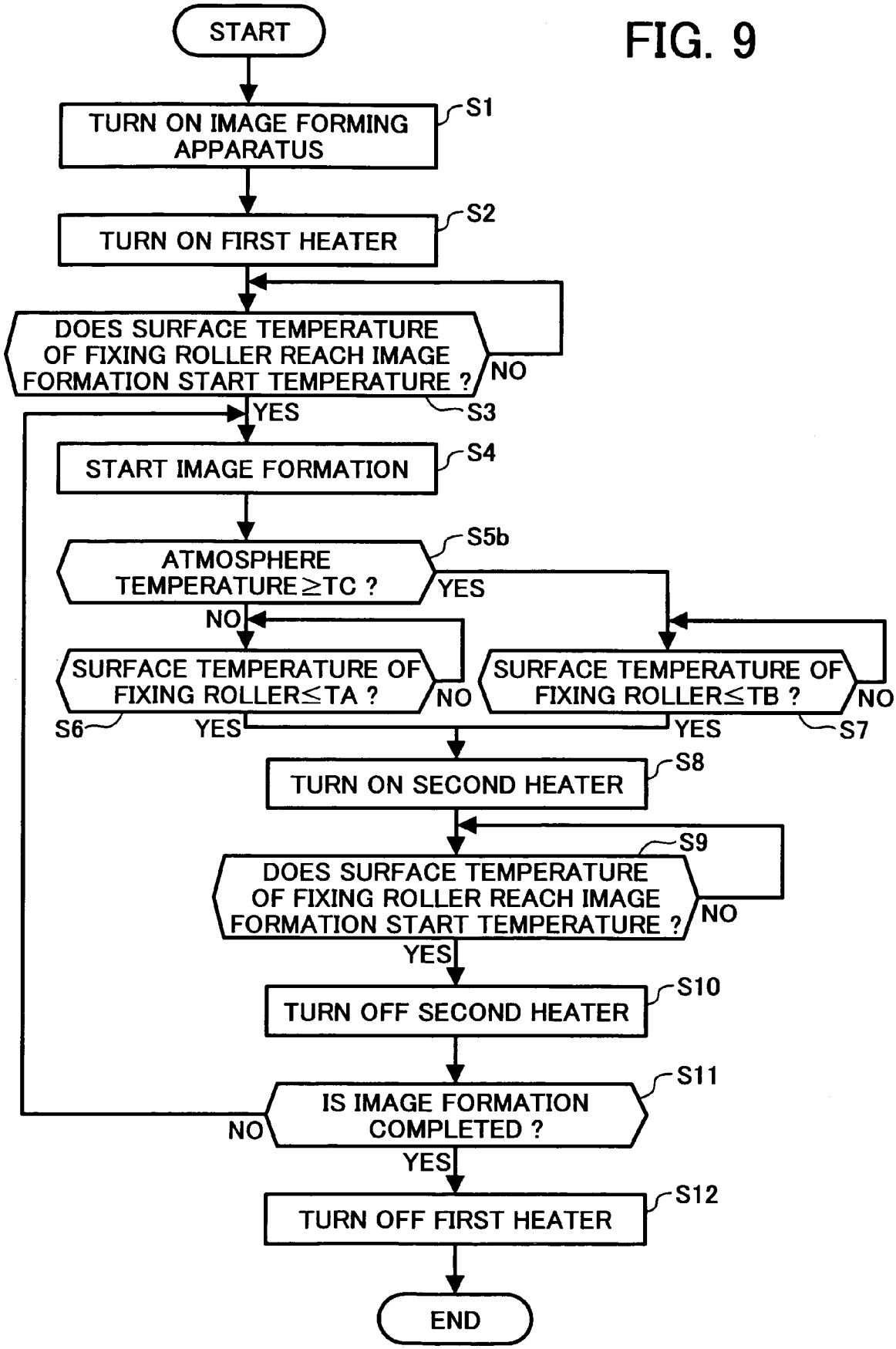
FIG. 9 is a flowchart of heating control operation steps of the CPU according to another embodiment of the present invention.
Figure 10:
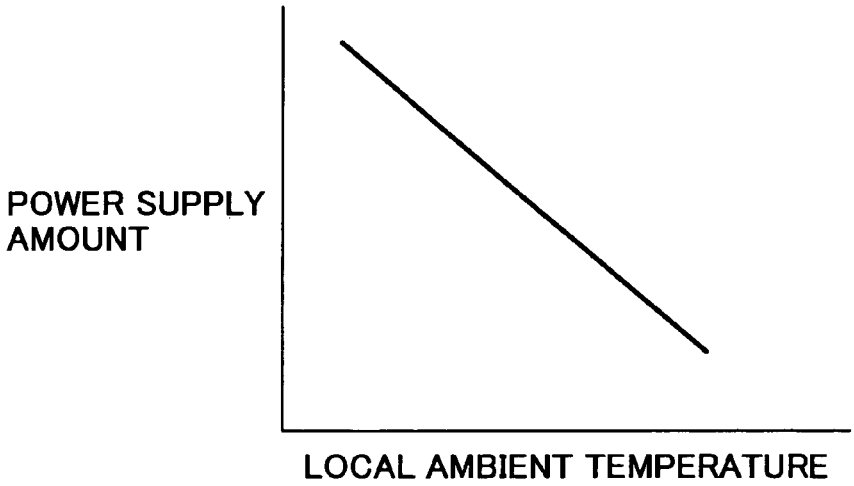
FIG. 10 is a graph showing the variation of the amount of power supply from a capacitor as a function of local ambient temperature in the vicinity of the fixing roller.

FIG. 8 is a block diagram of a control circuit of a fixing device according to another embodiment of the present invention. FIG. 9 is a flowchart of heating control operation steps of the CPU 13 according to another embodiment of the present invention. FIG. 10 is a graph showing a relationship between the amount of power supplied from the capacitor 18 and the local ambient temperature.

In this embodiment, the heating control operation of the CPU 13 is performed based on the local ambient temperature in the vicinity of the fixing roller 1. As illustrated in FIG. 8, the fixing device of this embodiment includes an ambient temperature sensor 20 at any desired position in the fixing device in the vicinity of the fixing roller 1. The output from the temperature sensor 20 is input to the CPU 13 via the input circuit 12.

In this embodiment, as shown in FIG. 9, after an image forming apparatus is turned on in step S1, the heating control operation steps S2 through S4 in FIG. 9 are performed similarly as in steps S2 through S4 in FIG. 4. In step S5*b*, the CPU 13 determines if the local ambient temperature detected by the temperature sensor 20 is equal to or greater than a reference ambient temperature (TC). If the answer is NO in step S5*b*, the CPU 13 determines if the surface temperature of the fixing roller 1 detected by the temperature sensor 3 is equal to or less than the second reference temperature in step S6. If the answer is YES in step S5*b*, the CPU 13 determines if the surface temperature of the fixing roller 1 detected by the temperature sensor 3 is equal to or less than the first reference temperature in step S7. The heating control operation steps S8 through S12 are performed similarly as in steps S8 through S12 in FIG. 4. With the above-described heating control operation, the surface temperature of the fixing roller 1 is maintained at an adequate fixing temperature in the range between the first reference temperature and the second reference temperature.

The position where the ambient temperature sensor 20 detects the temperature in the vicinity of the fixing roller 1 and the reference ambient temperature are determined according to experimental results.

As shown in the graph of FIG. 10, the amount of power supplied from the capacitor 18 and the local ambient temperature are in inverse proportion. Therefore, if this relation is stored in a table, the CPU 13 can retrieve the amount of power to be supplied from the capacitor 18 to the second heater 5 based on the local ambient temperature. Thus, the CPU 13 can control the amount of power supplied from the capacitor 18 to the second heater 5 based on the retrieved information just explained.

Figure 11:
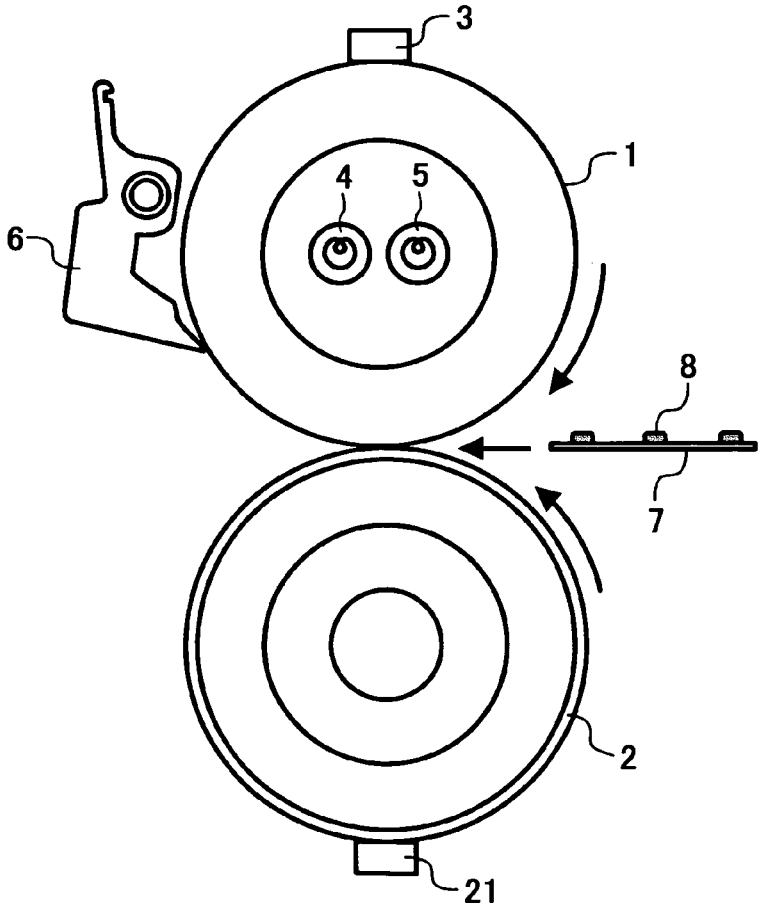
FIG. 11 is a schematic view of a fixing device according to another embodiment of the present invention.
Figure 12:
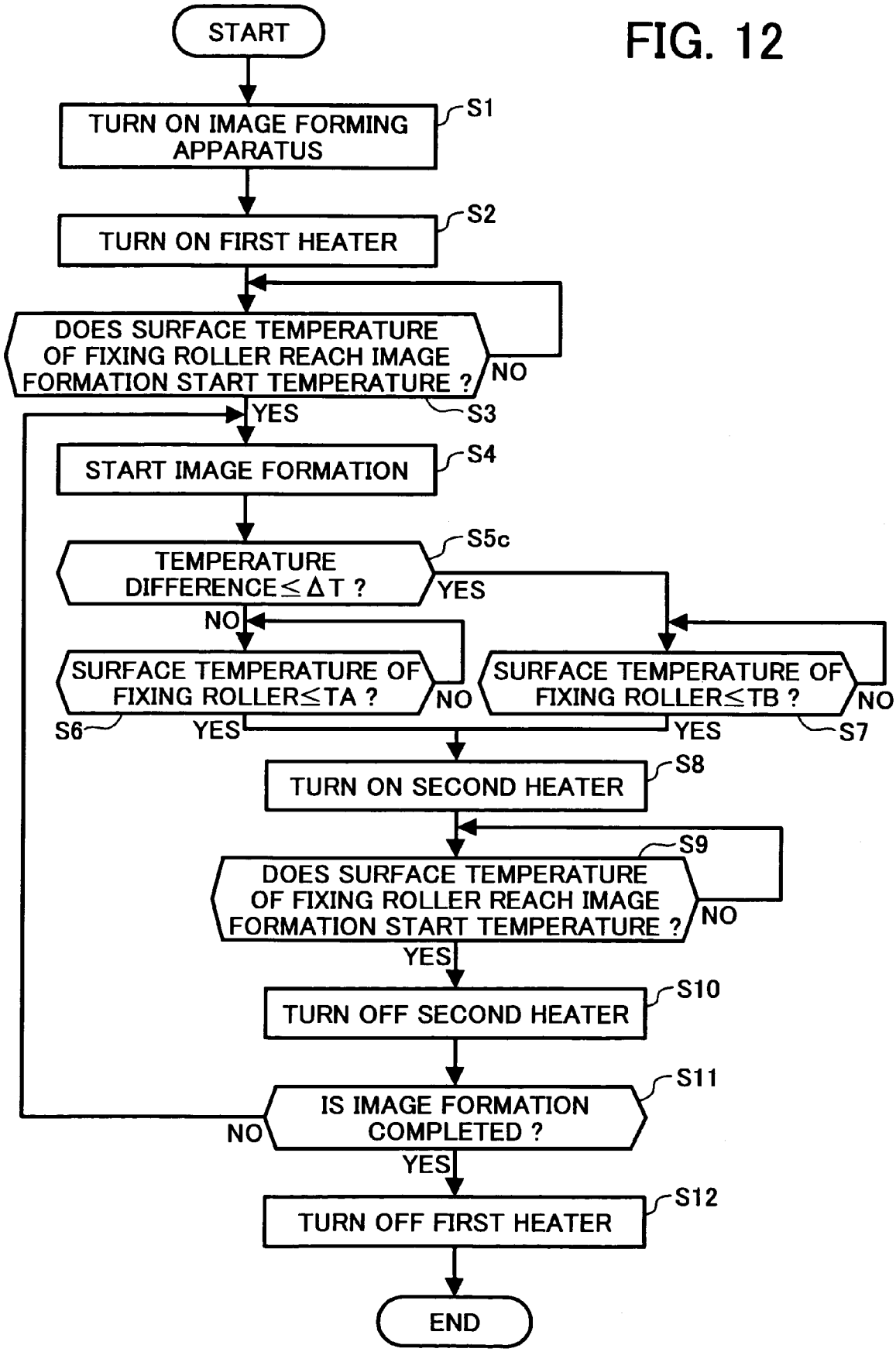
FIG. 12 is a flowchart of heating control operation steps of the CPU according to another embodiment of the present invention.
Figure 13:
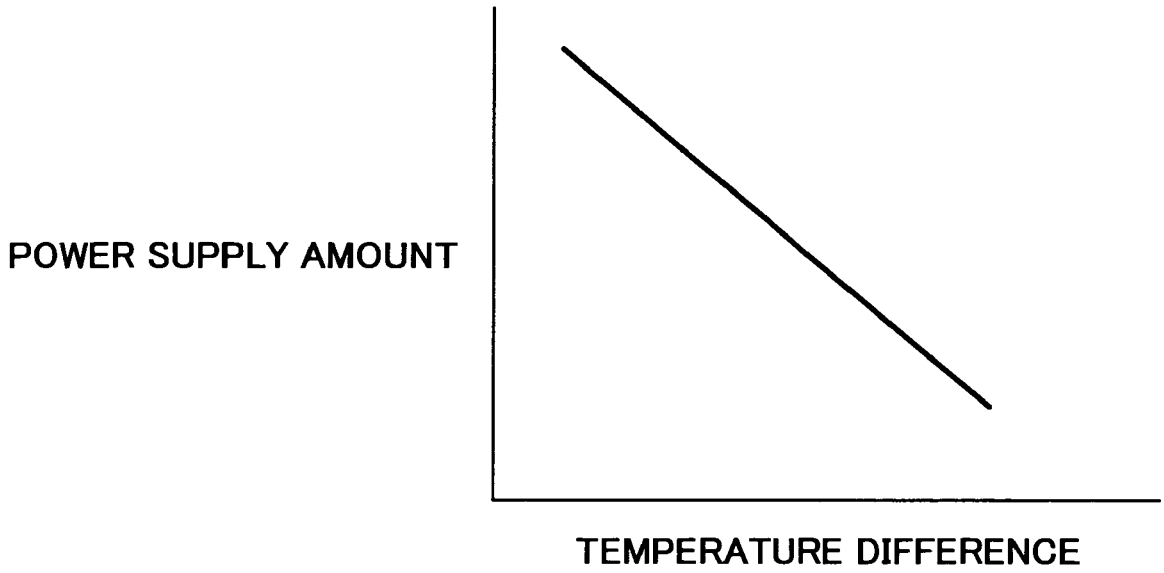
FIG. 13 is a graph showing the variation of the amount of power supply from a capacitor as a function of the difference between the surface temperature of the fixing roller and the surface temperature of a pressing roller.

FIG. 11 is a schematic view of a fixing device according to another embodiment of the present invention. FIG. 12 is a flowchart of heating control operation steps of the CPU 13 according to another embodiment of the present invention. FIG. 13 is a graph showing a relationship between the amount of power supplied from the capacitor 18 and the temperature difference between the surface temperature of the fixing roller 1 and the surface temperature of the pressing roller 2.

In this embodiment, the heating control operation of the CPU 13 is performed based on the temperature difference between the surface temperature of the fixing roller 1 and the surface temperature of the pressing roller 2. As compared to the fixing device of FIG. 1, the fixing device of FIG. 11 further includes a temperature sensor 21 that detects the surface temperature of the pressing roller 2.

In this embodiment, as shown in FIG. 12, after an image forming apparatus is turned on in step S1, the heating control operation steps S2 through S4 in FIG. 12 are performed similarly as in steps S2 through S4 in FIG. 4. In step S5*c*, the CPU 13 calculates the temperature difference between the surface temperature of the fixing roller 1 and the surface temperature of the pressing roller 2 based on outputs from the temperature sensors 3 and 21. Further, the CPU 13 determines if the calculated temperature difference is equal to or less than a temperature difference reference value (ΔT) in step S5*c*. If the answer is NO in step S5*c*, the CPU 13 determines if the surface temperature of the fixing roller 1 detected by the temperature sensor 3 is equal to or less than the second reference temperature in step S6. If the answer is YES in step S5*c*, the CPU 13 determines if the surface temperature of the fixing roller 1 detected by the temperature sensor 3 is equal to or less than the first reference temperature in step S7. The heating control operation steps S8 through S12 are performed similarly as in steps S8 through S12 in FIG. 4. With the above-described heating control operation, the surface temperature of the fixing roller 1 is maintained at an adequate fixing temperature in the range between the first reference temperature and the second reference temperature. The temperature difference reference value is determined based on experimental results.

As shown in FIG. 13, the amount of power supplied from the capacitor 18 and the difference in surface temperatures are in inverse proportion. Therefore, if this relation is stored in a table, the CPU 13 can retrieve the amount of power to be supplied from the capacitor 18 to the second heater 5 based on the detected difference in surface temperatures. Thus, the CPU 13 can control the amount of power supplied from the capacitor 18 to the second heater 5 based on the retrieved information just described.

Figure 14:
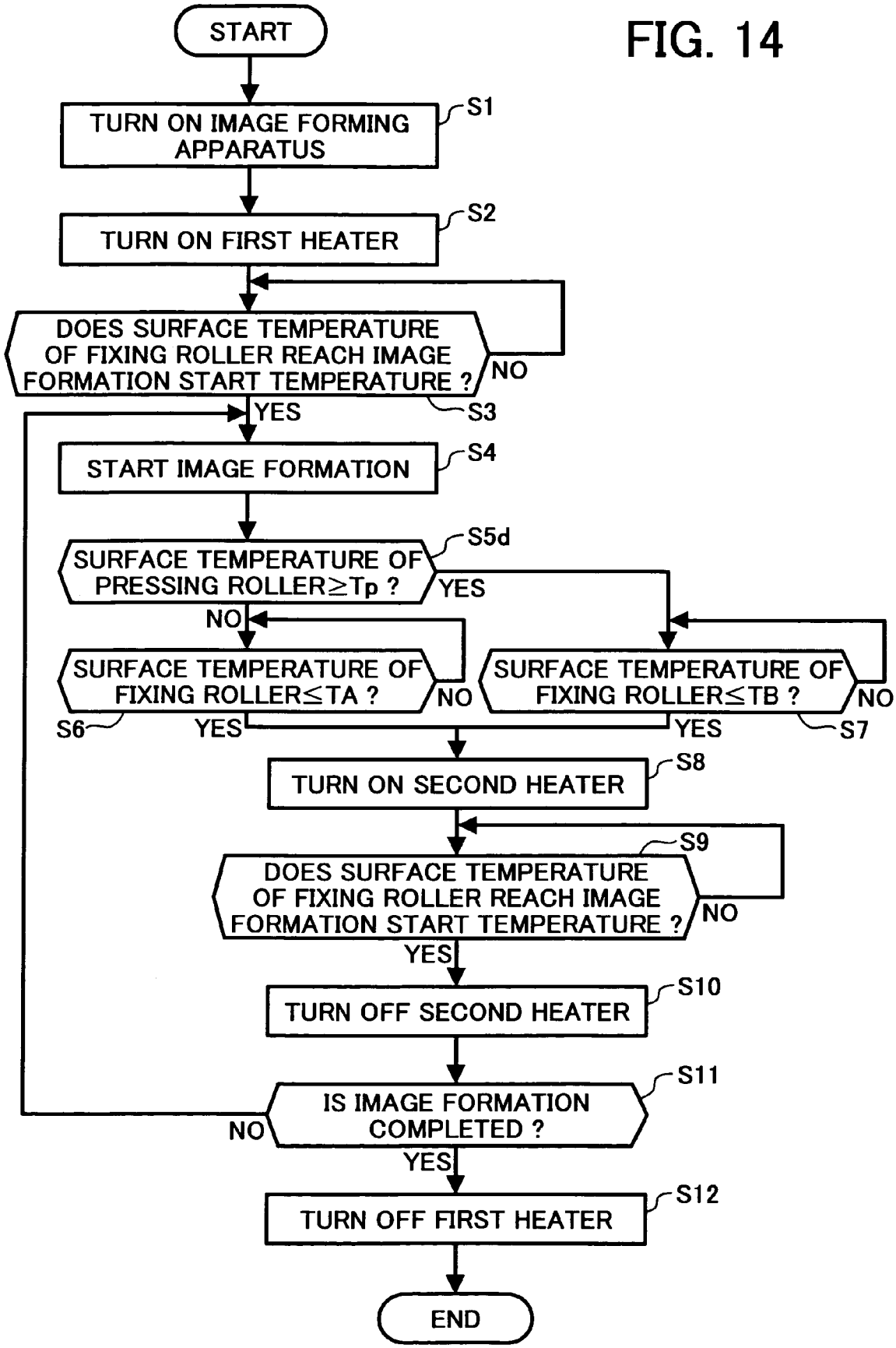
FIG. 14 is a flowchart of heating control operation steps of the CPU according to another embodiment of the present invention.
Figure 15:
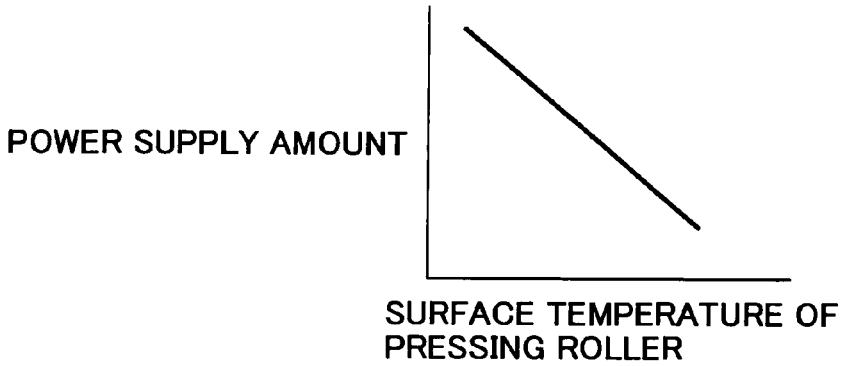
FIG. 15 is a graph showing the variation of the amount of power supply from a capacitor as a function of the surface temperature of the pressing roller.

FIG. 14 is a flowchart of heating control operation steps of the CPU 13 according to another embodiment of the present invention. FIG. 15 is a graph showing a relationship between the amount of power supplied from the capacitor 18 and the surface temperature of the pressing roller 2.

In this embodiment, the heating control operation of the CPU 13 is performed based on the surface temperature of the pressing roller 2. The fixing device of this embodiment also includes the temperature sensor 21 to detect the surface temperature of the pressing roller 2 like the fixing device illustrated in FIG. 11. The output from the temperature sensor 21 is input to the CPU 13.

In this embodiment, as shown in FIG. 14, after an image forming apparatus is turned on in step S1, the heating control operation steps S2 through S4 in FIG. 14 are performed similarly as in steps S2 through S4 in FIG. 4. In step S5*d*, the CPU 13 determines if the surface temperature of the pressing roller 2 detected by the temperature sensor 21 is equal to or greater than a reference temperature (Tp). If the answer is NO in step S5*d*, the CPU 13 determines if the surface temperature of the fixing roller 1 detected by the temperature sensor 3 is equal to or less than the second reference temperature in step S6. If the answer is YES in step S5*d*, the CPU 13 determines if the surface temperature of the fixing roller 1 detected by the temperature sensor 3 is equal to or less than the first reference temperature in step S7. The heating control operation steps S8 through S12 are performed similarly as in steps S8 through S12 in FIG. 4. With the above-described heating control operation, the surface temperature of the fixing roller 1 is maintained at an adequate fixing temperature in the range between the first reference temperature and the second reference temperature. The reference temperature Tp is determined based on experimental results.

As shown in FIG. 15, the amount of power supplied from the capacitor 18 and the surface temperature of the pressing roller 2 are in inverse proportion. Therefore, if this relation is stored in a table, the CPU 13 can retrieve the amount of power to be supplied from the capacitor 18 to the second heater 5 based on the surface temperature of the pressing roller 2. Thus, the CPU 13 can control the amount of power supplied from the capacitor 18 to the second heater 5 based on the retrieved information just described.

Figure 16:
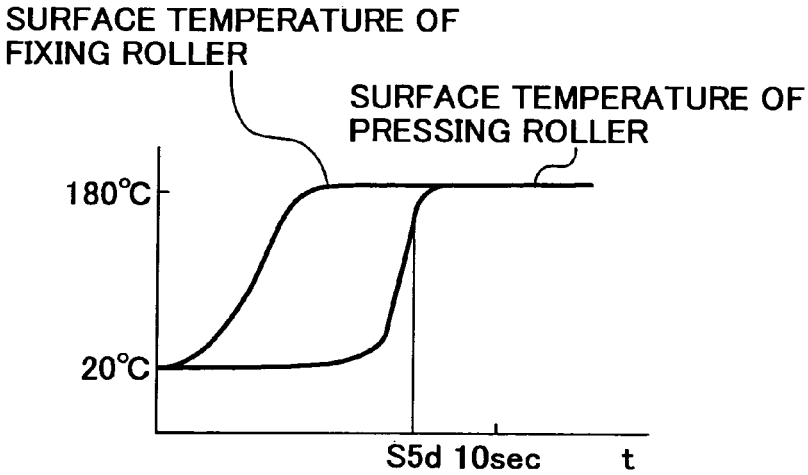
FIG. 16 is a graph showing the variation of the surface temperature of the fixing roller and the pressing roller with time when the fixing roller is heated.

FIG. 16 is a graph showing a relationship between the surface temperatures of the fixing roller 1 and the pressing roller 2 as a function of time when the fixing roller 1 is heated. In FIG. 16, the surface temperature of the pressing roller 2 rises while absorbing heat from the fixing roller 1 (i.e., due to heat transfer from the fixing roller 1 to the pressing roller 2). If a heating device such as a heater is provided to the pressing roller 2, the graph shows different characteristics. The reasons why the surface temperature of the pressing roller 2 remains low when the fixing roller 1 is warmed-up (heated-up) are considered as follows: (1) a heating device is not provided to the pressing roller 2; (2) even if the heating device is provided to the pressing roller 2, a heating-up speed of the heating device is low; and (3) the thermal capacity of the pressing roller 2 is large. The graph may show different characteristic depending on conditions (1) through (3).

The step S5*d* of the heating control operation of the CPU 13 in FIG. 14, in which the CPU 13 determines if the surface temperature of the pressing roller 2 detected by the temperature sensor 21 is equal to or greater than the reference temperature Tp, takes less than 10 seconds since the fixing roller 1 is heated. Such a timing is denoted by the character "S5*d*" in FIG. 16. In the step S5*d* of the heating control operation of the CPU 13 in FIG. 14, if the surface temperature of the pressing roller 2 is less than the reference temperature Tp, the pressing roller 2 absorbs the heat of the fixing roller 1 because the surface temperature of the pressing roller 2 is relatively low. Therefore, the second heater 5 is turned on at an early stage (i.e., when the surface temperature of the fixing roller 1 reaches the second reference temperature) to prevent the surface temperature of the fixing roller 1 from rapidly dropping due to heat loss to the pressing roller 2. On the other hand, if the surface temperature of the pressing roller 2 is equal to or greater than the reference temperature Tp, the pressing roller 2 does not tend to absorb the heat of the fixing roller 1 because the surface temperature of the pressing roller 2 is relatively high. Therefore, the second heater 5 is turned on at a later stage (i.e., when the surface temperature of the fixing roller 1 reaches the first reference temperature).

Figure 17:
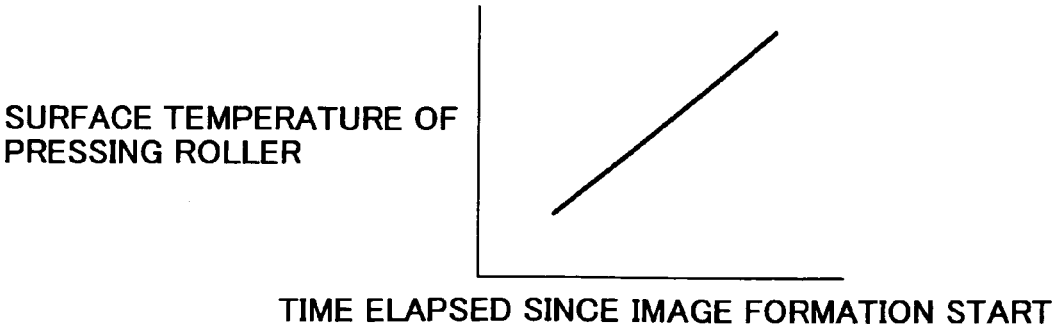
FIG. 17 is a graph showing the variation of the surface temperature of the pressing roller with time elapsed since the start of image formation.
Figure 18:
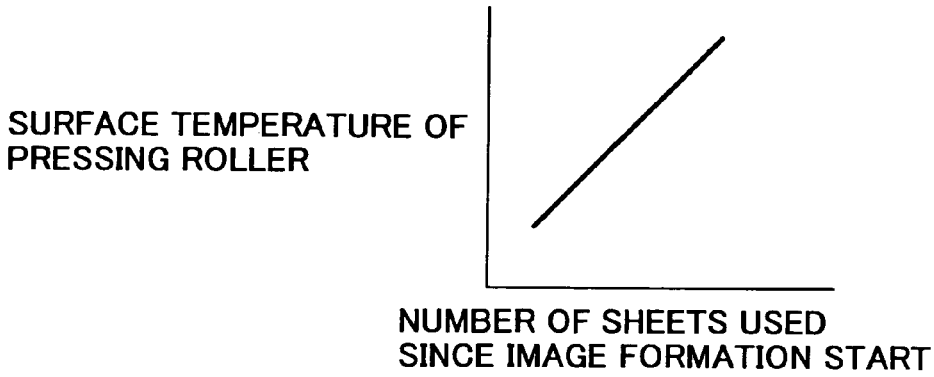
FIG. 18 is a graph showing the variation of the surface temperature of the pressing roller as a function of the number of sheets used since the start of image formation.
Figure 19:
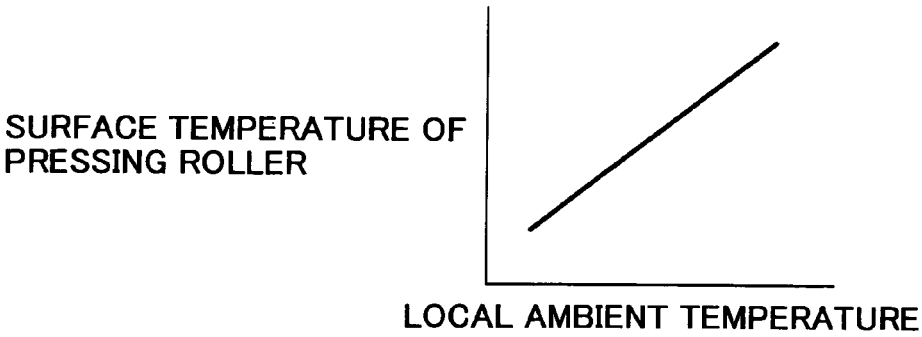
FIG. 19 is a graph showing the variation of the surface temperature of the pressing roller as a function of local ambient temperature in the vicinity of the fixing roller.
Figure 20:
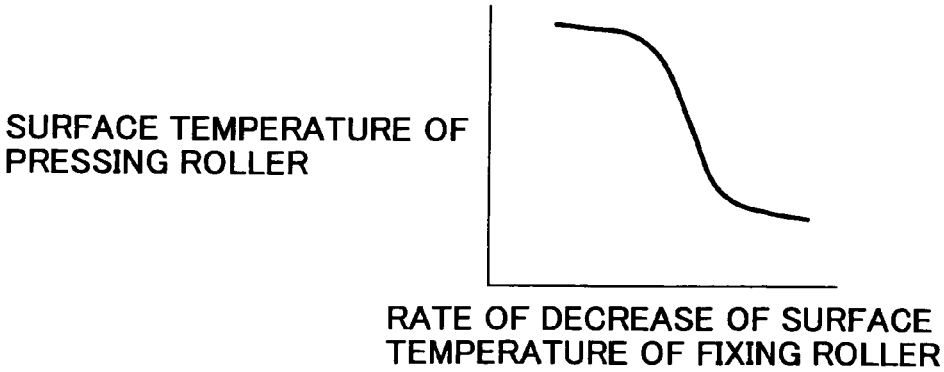
FIG. 20 is a graph showing the variation of the surface temperature of the pressing roller as a function of the rate of decrease of the surface temperature of the fixing roller.

Instead of detecting the surface temperature of the pressing roller 2 by the temperature sensor 21, the surface temperature of the pressing roller 2 can be estimated based on at least one of the time elapsed since the start of image formation, the number (N) of sheets that have passed through the nip part between the fixing roller 1 and the pressing roller 2 since the start of image formation, the local ambient temperature in the vicinity of the fixing roller 1, and a change of the surface temperature of the fixing roller 1. FIG. 17 is a graph showing a relationship between the surface temperature of the pressing roller 2 and the time elapsed since the start of image formation. FIG. 18 is a graph showing a relationship between the surface temperature of the pressing roller 2 and the number of sheets on which images are formed since the start of image formation (i.e., a number of sheets that have passed through the nip part between the fixing roller 1 and the pressing roller 2 since the start of image formation). FIG. 19 is a graph showing a relationship between the surface temperature of the pressing roller 2 and the local ambient temperature in the vicinity of the fixing roller 1. FIG. 20 is a graph showing a relationship between the surface temperature of the pressing roller 2 and the change in surface temperature of the fixing roller 1 (i.e., the rate of decrease of the surface temperature of the fixing roller 1). As seen from FIGS. 17 through 19, the time elapsed since the start of image formation, the number of sheets on which images are formed since the start of image formation, and the local ambient temperature in the vicinity of the fixing roller 1 is proportional to the surface temperature of the pressing roller 2. Therefore, the surface temperature of the pressing roller 2 can be estimated from the time elapsed since the start of image formation, the number of sheets on which images are formed since the start of image formation, and the local ambient temperature in the vicinity of the fixing roller 1.

With regard to the relation between the surface temperature of the pressing roller 2 and a change of the surface temperature of the fixing roller 1 (i.e., rate of decrease of the surface temperature of the fixing roller 1), the graph of FIG. 20 does not show an inverse proportional characteristic but shows a monotone decreasing characteristic. This results from the fact that the amount of heat transferred from the fixing roller 1 to the pressing roller 2 varies depending on the surface temperature of the pressing roller 2. It can be seen that when the rate of decrease of the surface temperature of the fixing roller 1 is low, the surface temperature of the pressing roller 2 is high. On the other hand, when the rate of decrease of the surface temperature of the fixing roller 1 is high, the surface temperature of the pressing roller 2 is low. Thus, the surface temperature of the pressing roller 2 can be estimated from a change of the surface temperature of the fixing roller 1.

FIGS. 17 through 20 show conceptual graphs. In an actual heating control operation, graphs, which are drawn from data obtained in each actual apparatus, are used.

According to the embodiments of the present invention, the amount of heat transferred from the fixing roller 1 to the pressing roller 2 can be estimated based on the above-described various parameters, such as, the time elapsed since the start of image formation, the number of sheets used since the start of image formation (i.e., the number of sheets that have passed through the nip part between the fixing roller 1 and the pressing roller 2 since the start of image formation), the local ambient temperature in the vicinity of the fixing roller 1, the temperature difference between the surface temperature of the fixing roller 1 and the surface temperature of the pressing roller 2, and the surface temperature of the pressing roller 2. The timing and duration for the process of supplying power to the second heater 5 can be set according to the estimated amount of heat transferred from the fixing roller 1 to the pressing roller 2. The relation between the amount of heat transferred from the fixing roller 1 to the pressing roller 2 and each parameter may be stored in a table in a read-only memory (ROM, not shown). The CPU 13 may set the timing and duration for the process of supplying power to the second heater 5 while referring to the table in the ROM.

In the above-described embodiments, the CPU 13 functions as a device that estimates the surface temperature of the pressing roller 2 and the amount of heat transferred from the fixing roller 1 to the pressing roller 2 as well as a control device that controls the amount of power supplied from the capacitor 18 to the second heater 5. The CPU 13 performs the heating control operation and the estimating operation based on a program stored in the ROM while using a random-access memory (RAM, not shown) as a work area.

In the above-described heating control operation of the CPU 13, the CPU 13 turns on and off the second heater 5. Specifically, the amount of power supplied from the capacitor 18 to the second heater 5 is changed by shutting off and turning on a supply of power from the capacitor 18 to the second heater 5. However, in view of the temperature decrease and thermal capacity of the second heater 5, a low-level power may be constantly supplied to the second heater 5 from the commercial power source 17. Then, an additional power may be supplied to the second heater 5 from the capacitor 18 intermittently or gradually.

In the above-described embodiments, the fixing device includes the first heater 4 and the second heater 5 as heat sources. If the capacity of the capacitor 18 is large enough to allow the two heaters 4 and 5 to generate a sufficient amount of heat, only one heater may be used instead of the two heaters.

Further, the second heater 5 may be provided to the pressing roller 2 instead of the fixing roller 1. In this construction, the amount of heat transferred from the fixing roller 1 to the pressing roller 2 at the time of fixing the toner image 8 on the transfer sheet 7 may be reduced, thereby minimizing the decrease in surface temperature of the fixing roller 1.

In the above-described embodiments, the capacitor 18 is used as an auxiliary power source. The advantages of using a capacitor as an auxiliary power source are as follows.

(1) Time for charging the capacitor is short;

(2) In the case of using a nickel-cadmium battery as an auxiliary power source, which is generally used as a secondary battery, several hours are necessary for charging the nickel-cadmium battery even though the nickel-cadmium battery is rapidly charged. In the case of using a capacitor as an auxiliary power source, the capacitor can be charged rapidly in about several minutes; and (3) The useful lifetime of the nickel-cadmium battery is short because the nickel-cadmium battery can be charged and discharged about 500 through 1000 times. On the other hand, the capacitor can be used rather endlessly. In addition, the capacitor is not easily deteriorated even if the capacitor is charged and discharged repeatedly.

According to the embodiments of the present invention, the CPU 13 controls the surface temperature of the fixing roller 1 while changing the amount of power supplied from the capacitor 18 to the second heater 5 based on the above-described various parameters and based on the estimated surface temperature of the pressing roller 2 and the estimated amount of heat transferred from the fixing roller 1 to the pressing roller 2. Thereby, the surface temperature of the fixing roller 1 can be prevented from falling below a lower limit of fixing temperature after the start of image formation. As a result, a fixing failure can be obviated, and a high quality image can be obtained.

Figure 21:
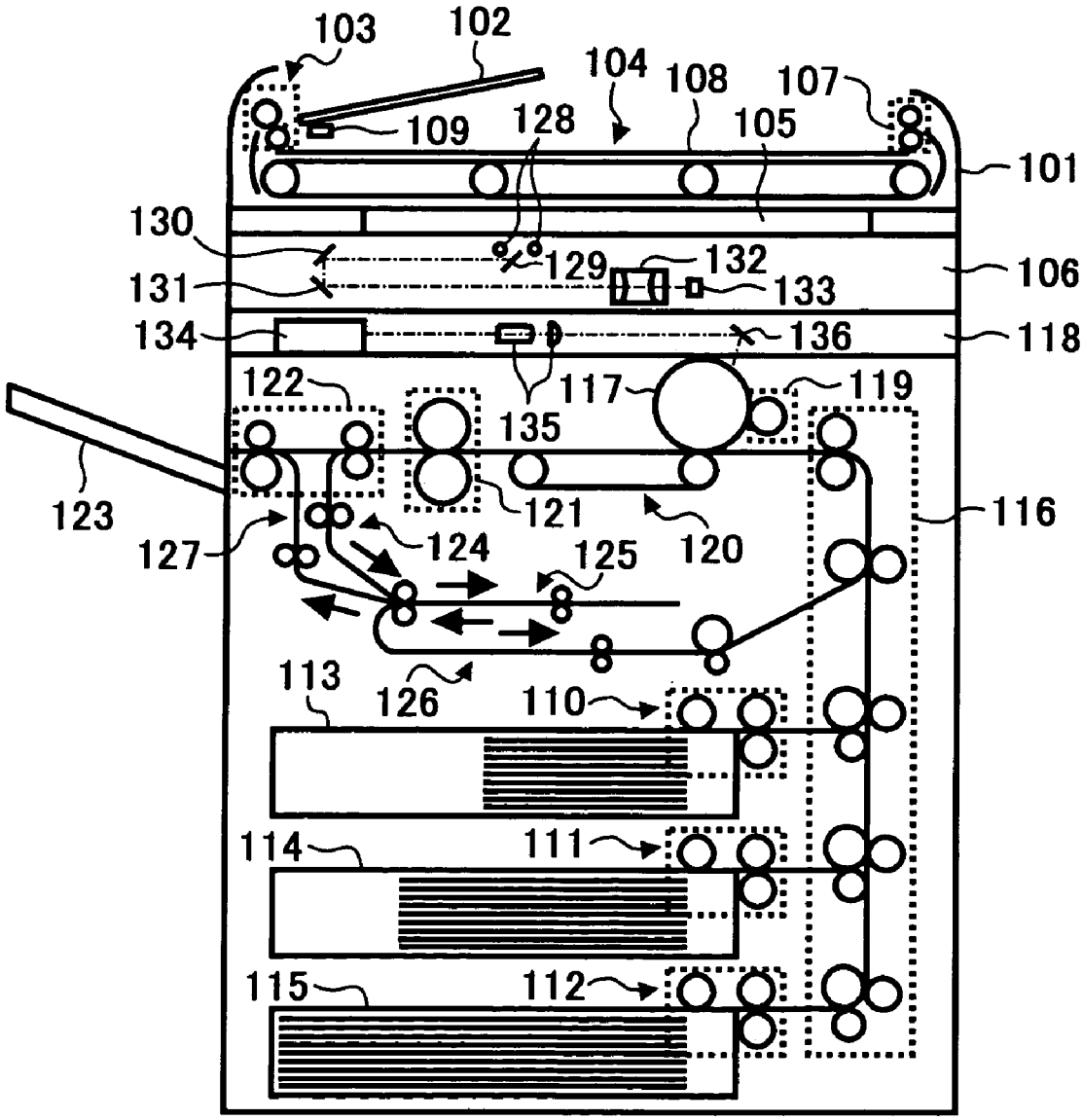
FIG. 21 is a schematic view of an image forming apparatus including the fixing device according to the embodiments of the present invention.

FIG. 21 is a schematic view of an image forming apparatus including the fixing device according to the embodiments of the present invention. The image forming apparatus of FIG. 21 is a so-called multi function peripheral image forming apparatus having, for example, a printer function and a facsimile function in addition to a copier function. An operator of the image forming apparatus operates an application switch key provided on an operation unit to sequentially select the above functions. When the operator selects the copier function, the apparatus is in a copier mode. When the operator selects the printer function, the apparatus is in a printer mode. When the operator selects the facsimile function, the apparatus is in a facsimile mode.

The image forming apparatus includes an automatic document feeder (ADF) 101, an image reading device 106, an image writing device 118, an image forming device including a photoreceptor 117 and a developing device 119, and a sheet feeding device including a first tray 113, a second tray 114, a third tray 115, and a vertical sheet conveying unit 116 in an order from an upper side to a lower side of the apparatus. The operation of the image forming apparatus in the copier mode is as follows.

In the copier mode, the operator stacks original documents on an original document tray 102 of the ADF 101 face up and then presses a start key positioned on the operation unit. In response, a sheet pickup roller 103 and a sheet feeding belt 104 feed the bottom original document to a predetermined position on an original document setting table 105 made of a contact glass platen. The ADF 101 has a counting function for counting original documents every time the ADF 101 feeds the original document. The image reading device 106 serving as an image inputting device reads the image of the original document on the original document setting table 105. Subsequently, the original document is discharged onto a tray 108 by the sheet feeding belt 104 and a pair of sheet discharging rollers 107. The sheet feeding roller 103, the sheet feeding belt 104, and the sheet discharging roller 107 are driven by a motor.

An original document set sensor 109 determines whether or not the next original document is present on the original document tray 102. When the original document set sensor 109 determines that the next original document is present on the original document tray 102, the next original document is dealt with in the same manner as the preceding original document.

The image reading device 106 includes lamps 128, a first mirror 129, a second mirror 130, a third mirror 131, an imaging lens 132, and a charge-coupled device (CCD) 133. A first moving carriage (not shown) carries the lamps 128 and the first mirror 129. A second moving carriage (not shown) carries the second mirror 130 and the third mirror 131. The first moving carriage and the second moving carriage slidably move in the same direction at a speed ratio of two to one such that a light path is maintained at a predetermined length. The lamps 128 irradiate an image surface of the original document with light. The light reflected from the image surface of the original document is directed to the second moving carriage. The light reflected from the second mirror 130 and the third mirror 131 is imaged on the CCD 133 through the imaging lens 132. Image data of the original document read by the image reading device 106 is stored in a memory (not shown).

The image writing device 118 converts the image data into optical data via an image processing device (not shown). The image writing device 118 includes a light output unit 134, a fθ lens 135, and a mirror 136. A laser light corresponding to the optical data is light-modulated by the light output unit 134. The light-modulated laser light passes through the fθ lens 135, and is reflected from the mirror 136 toward the surface of the photoreceptor 117. The photoreceptor 117 is, for example, in a shape of a drum, and is driven to rotate by a main motor.

The surface of the photoreceptor 117 is uniformly charged by a charging device (not shown), and is exposed to the light-modulated laser light emitted from the image writing device 118. Thereby, an electrostatic latent image is formed on the surface of the photoreceptor 117. A developing device 119 develops the electrostatic latent image with toner and forms a toner image.

A first sheet feeding device 110, a second sheet feeding device 111, and a third sheet feeding device 112 include the first tray 113, the second tray 114, and the third tray 115, respectively. Each of the first, second, and third trays 113, 114, and 115 is loaded with a stack of sheets. A sheet fed from any one of the sheet feeding devices 110 through 112 selected is conveyed to a position where the sheet contacts the photoreceptor 117, by the vertical sheet conveying unit 116.

A power source (not shown) applies a bias for image transfer to a sheet conveying belt 120 which functions as a sheet conveying device and a transfer device. While the sheet conveying belt 120 conveys the sheet at the same linear velocity as the photoreceptor 117, the toner image is transferred from the photoreceptor 117 onto the sheet due to the bias applied to the sheet conveying belt 120. A fixing device 121 fixes the toner image on the sheet. The sheet having a fixed toner image is discharged onto a sheet discharging tray 123 by a sheet discharging unit 122. A cleaning device (not shown) cleans the surface of the photoreceptor 117 after the image transfer.

The photoreceptor 117, the charging device, the image writing device 118, the developing device 119, and the transfer device function as an image forming device that forms an image on a sheet in accordance with image data.

The procedure described above pertains to a simplex copy mode as distinguished from a duplex copy mode. In the duplex copy mode for forming images on dual sides of a sheet, the sheet fed from any one of the trays 113 through 15 and carrying an image on single side thereof is steered by the sheet discharging unit 122 into a duplex copy path 124. A sheet reversing unit 125 switches back the sheet entered the duplex copy path 124 to reverse the sheet upside down and then hands the reversed sheet over to a duplex sheet conveying unit 126.

The duplex sheet conveying unit 126 conveys the sheet to the vertical sheet conveying unit 116. The vertical sheet conveying unit 116 again conveys the sheet to the photoreceptor 117, so that another toner image is transferred from the photoreceptor 117 to the other side of the sheet. The fixing device 121 again fixes this toner image on the sheet to produce a duplex copy. At this time, the sheet discharging unit 122 discharges the duplex copy to the sheet discharging tray 123.

When the sheet or print should be reversed upside down and then discharged onto the sheet discharging tray 123, the sheet reversed upside down by the sheet reversing unit 125 is directly discharged onto the sheet discharging tray 123 by the sheet discharging unit 122 via a reversed sheet discharging path 127.

The printer mode is performed similarly as in the copier mode except that image data fed from the outside of the apparatus is input to the image writing device 118 in place of the image data of the original document read by the image reading device 106.

In the facsimile mode, the image data of the original document read by the image reading device 106 is sent to a desired destination via a facsimile transmitter/receiver (not shown). Image data from a sending station is input to the facsimile transmitter/receiver and delivered to the image writing device 118. The image forming device forms an image on a sheet in accordance with the received image data.

When the operator standing by the apparatus selects the copier mode, it is necessary to instantaneously warm up the fixing device 121. Only in the copier mode, the CPU 13 causes the capacitor 18 to operate via the switch 15, and thereby the second heater 5 is powered by the capacitor 18. In the printer mode or the facsimile mode, the CPU 13 does not cause the capacitor 18 to operate via the switch 15, i.e., it does not supply power from the capacitor 18 to the second heater 5. Therefore, the capacitor 18 is not operated more than necessary. Thus, the fixing failure does not occur in the copier mode in the image forming apparatus, so that a high quality image can be obtained. The fixing device 121 may have one of the configurations shown in FIGS. 1, 2, 8, and 11.

The present invention has been described with respect to the exemplary embodiments illustrated in the figures. However, the present invention is not limited to these embodiments and may be practiced otherwise.

Numerous additional modifications and variations of the present invention are possible in light of the above teachings. It is therefore understood that within the scope of the appended claims, the present invention may be practiced other than as specifically described herein.

The invention claimed is:

1. An image forming apparatus, comprising:

a storage device;

a heat source configured to receive power from the storage device;

a fixing member configured to be heated by the heat source;

a pressing member arranged to face the fixing member;

a sensor member configured to detect a temperature of the fixing member; and a control device configured to cause the storage device to supply power to the heat source when the sensor member senses a temperature of the fixing member has decreased below a first reference temperature from a start of an image forming operation, wherein the controller changes the first reference temperature based on at least one of the following factors, a rate of decrease of the temperature of the fixing member, a temperature of the pressing member, an ambient temperature, and a temperature difference between the fixing member and the pressing member.

2. The image forming apparatus of claim 1, wherein the control device changes the first reference temperature to a second reference temperature which is higher than the first reference temperature.

3. The image forming apparatus of claim 2, wherein ihe control device changes the first reference temperature to the second reference temperature when the temperature of the fixing member has decreased below the second reference temperature within a time period from the start of the image forming operation to a predetermined time.

4. The image forming apparatus of claim 2, wherein the control device changes the first reference temperature to the second reference temperature when the temperature of the fixing member is decreased below the second reference temperature during a time period when a predetermined number of sheets of paper have passed between the fixing member and the pressing member after the start of image formation.

5. The image forming apparatus of claim 2, wherein the control device changes the first reference temperature to the second reference temperature when the temperature of the pressing member is below a predetermined temperature.

6. The image forming apparatus of claim 2, wherein the control device changes the temperature from the first reference temperature to the second reference temperature when the ambient temperature is below a predetermined ambient temperature.

7. The image forming apparatus of claim 2, wherein the control device changes the temperature from the first reference temperature to the second reference temperature when the temperature difference between the fixing member and the pressing member is below a predetermined temperature difference.

8. An image forming apparatus, comprising:

a storage device;

a heat source configured to receive power from the storage device;

a fixing member configured to be heated by the heat source;

a pressing member arranged to face the fixing member;

a temperature sensor configured to detect a temperature of the fixing member; and a control device configured to control a power supply amount from the storage device to the heat source, wherein the control device causes the storage device to start to supply power to the heat source when a temperature of the fixing member has decreased to a second reference temperature TA higher than a first reference temperature TB within a predetermined period of time (t) from a start of image formation; and, in a case when the temperature of the fixing member has not decreased to the second reference temperature TA within the predetermined period of time (t) from the start of image formation, the control device causes the storage device to start power supply to the heat source when the temperature of the fixing member has decreased to the first reference temperature TB.

9. An image forming apparatus, comprising:

a storage device;

a heat source configured to receive power from the storage device;

a fixing member configured to be heated by the heat source;

a pressing member arranged to face the fixing member;

a temperature sensor configured to detect a temperature of the fixing member; and a control device configured to control a power supply amount from the storage device to the heat source, wherein the control device causes the storage device to start to supply power to the heat source when a temperature of the fixing member has decreased to a second reference temperature TA higher than a first reference temperature TB by the time a predetermined number of sheets has been fixed from a start of image formation; and, in a case when the temperature of the fixing member 1 has not decreased to the second reference temperature TA by the time the predetermined number of sheets has been fixed from the start of image formation, the control device causes the storage device to start to supply power to the heat source when the temperature of the fixing member has decreased to the first reference temperature TB.

* * * * *